United States Patent [19]

Soin

[11] 4,067,485

[45] Jan. 10, 1978

[54] PAINT TANK UNIT

[76] Inventor: Nikolay Soin, 2570 Princeton Drive, San Bruno, Calif. 94066

[21] Appl. No.: 754,507

[22] Filed: Dec. 27, 1976

[51] Int. Cl.[2] ..... B43K 5/04

[52] U.S. Cl. ..... 222/386.5; 401/145

[58] Field of Search ..... 222/95, 386.5; 401/145, 401/190

[56] References Cited

U.S. PATENT DOCUMENTS

| | | | |
|---|---|---|---|
| 1,632,559 | 6/1927 | Pedrick | 222/386.5 |
| 1,731,767 | 10/1929 | Cramer | 222/386.5 |
| 2,397,455 | 3/1946 | Chmeilowiec | 222/95 X |
| 3,174,658 | 3/1965 | Wittenberg et al. | 222/386.5 |
| 3,996,836 | 12/1976 | Lichtenberg | 222/95 |

*Primary Examiner*—Stanley H. Tollberg
*Attorney, Agent, or Firm*—Henry G. Kohlmann

[57] ABSTRACT

A convenient and efficient paint tank which utilizes water pressure as the pressure means for dispensing paint from the tank through the application device. More specifically a paint tank having an upper and lower chamber separated by a flexible diaphram. Paint and the like is introduced into the upper chamber by way of an access port and water is introduced into the lower chamber by a hose. The water induces a pressure against the diaphram forcing the paint out of the upper chamber and through a valve to the application device. Further, a way of introducing water into the upper chamber is also provided such that the tank will clean itself when the paint has been removed.

7 Claims, 3 Drawing Figures

PAINT TANK UNIT

BACKGROUND OF THE INVENTION

1. Field of the Invention

This invention relates to devices used for delivering paint from a container to a paint application device by exerting pressure on said paint and forcing it out of the container and through a hose or the like. The instant invention, however, eliminates the necessity of any special equipment other than the container and the application device itself.

2. Description of the Prior Art

Most prior art devices rely on compressed air to provide the pressure differential required for their operation. These prior art devices are typified by Howard, U.S. Pat. No. 3,195,170 and Mayden, U.S. Pat. No. 3,331,093. Such devices require, in addition to the paint container and dispensing apparatus, a means of providing a pressure differential by an air compressor or the like which not only requires a substantial investment for such additional equipment but also is an energy consuming means of creating such a differential. In addition, the paint container and dispensing apparatus must be separately cleaned, requiring the expenditure of substantial time and effort beyond that used for the painting activity itself.

The object of the present invention is to provide a paint dispensing container which requires no additional special equipment to create the required pressure differential.

Another object of the present invention is to provide a paint dispensing container which virtually cleans itself as well as all the application equipment connected thereto without the necessity of dismantling the device.

A further object of this invention is to provide a paint container which uses household water pressure for the pressure differential and water for cleaning said container.

SUMMARY OF THE INVENTION

A convenient and efficient container which is constructed of an upper and lower chamber having a flexible diaphram separating such chambers in the form of a derby hat, that is, having a flat circular outer rim surrounding a concave center which center is capable of reversing its position from either chamber whenever a pressure difference is applied between said upper and lower chambers. A liquid such as paint or the like is introduced into the upper chamber which chamber is connected to an applicator such as a paint roller or the like by means of a flexible hose. A water source is connected to said lower chamber by a conventional hose through a control valve. When the control valve is opened, water enters the lower chamber and induces a pressure differential causing the diaphram to rise into the upper chamber and force paint and the like contained therein out of the upper chamber and through the flexible hose to the applicator. When the diaphram has entirely reversed its position, it resists and contains the pressure and water and no further paint is forced out of chamber. Said diaphram is shaped so as to be slightly smaller than the inside of the upper chamber thus allowing a small space between the chamber and diaphram. The lower chamber and upper chambers are connected through a second valve by means of a tube. When substantially all paint has been removed, said second valve is opened and water from the lower chamber enters the upper chamber through a ring about the inside of the upper chamber having a series of holes and rinses said upper chamber and forces rinse water through the hose to the applicator thereby cleaning the entire apparatus.

The several advantages of the present device will be more readily apparent, understood and appreciated by reference to the detailed description which is to be considered in conjunction with the accompanying drawings.

DESCRIPTION OF SPECIFIC EMBODIMENT

Figure 1:
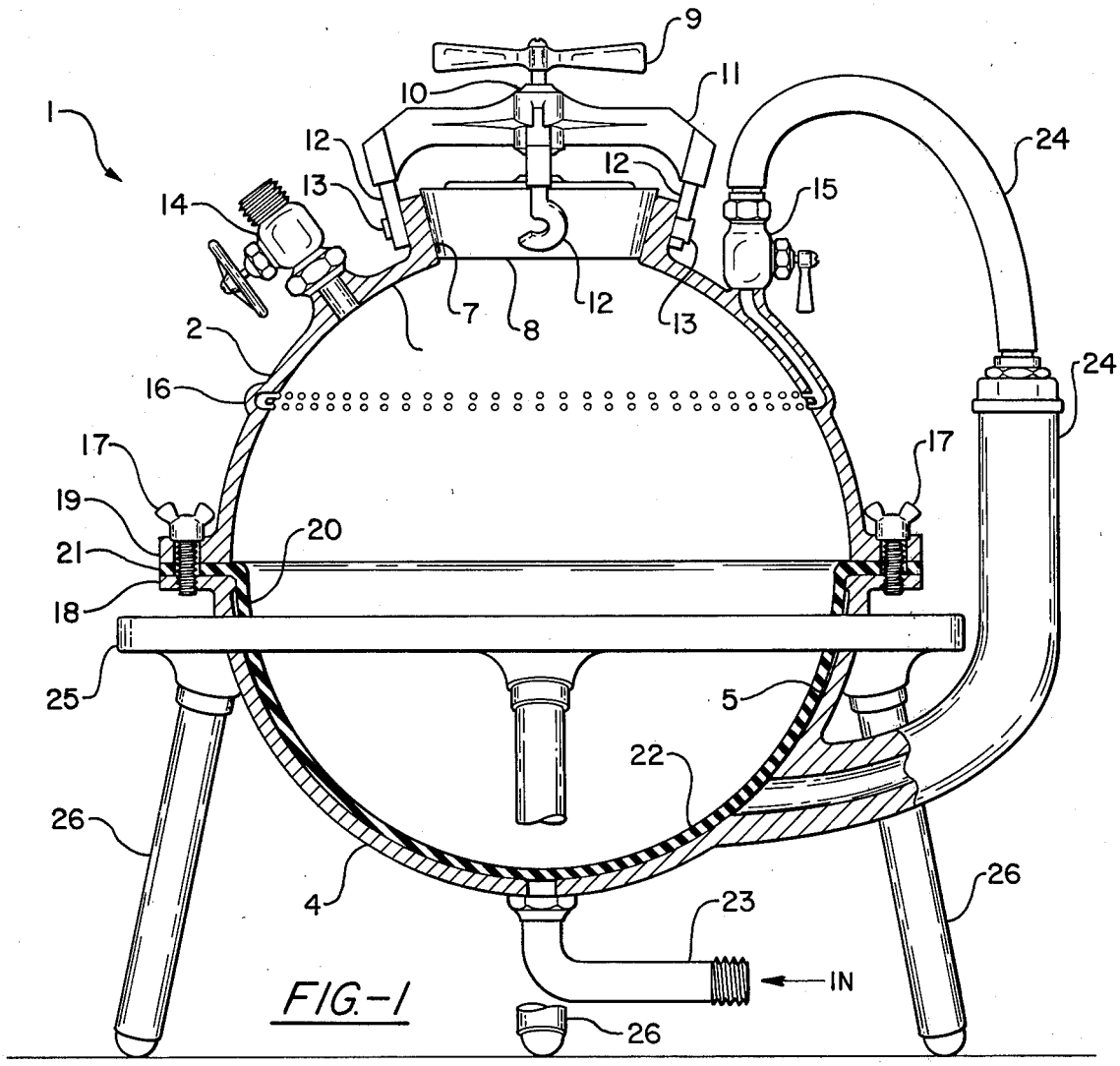
FIG. 1 is a cross-sectional view of said paint tank.
Figure 2:
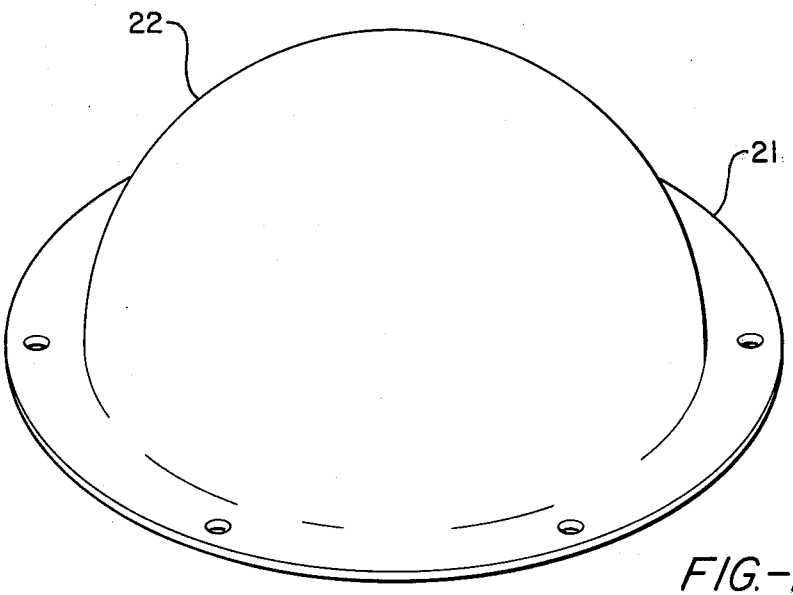
FIG. 2 is a perspective view of the diaphram.
Figure 3:
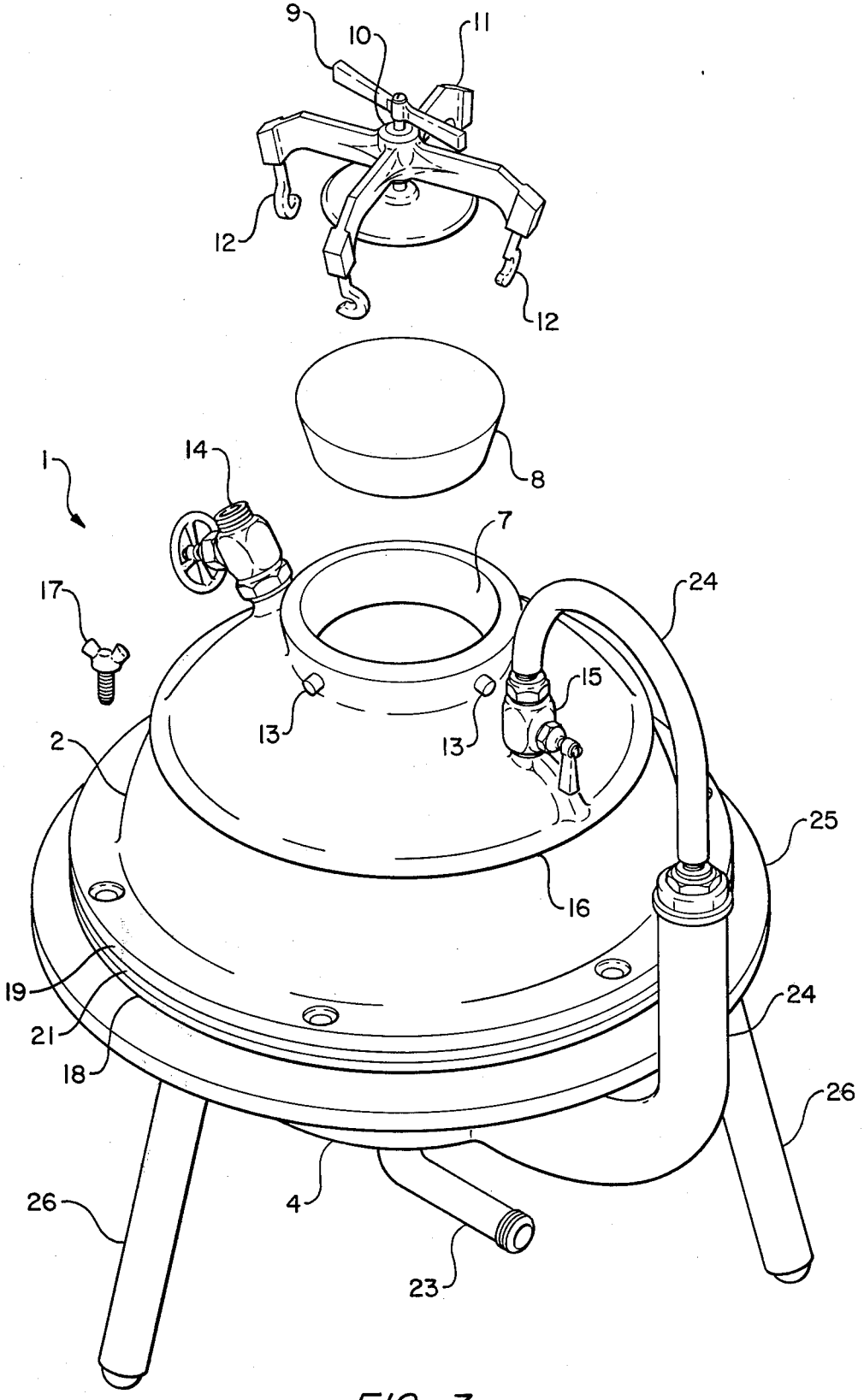
FIG. 3 is a perspective view of the paint tank exploding certain parts thereof.

With reference to the drawings, FIG. 1 shows a paint container 1 having an upper semi-spherical member 2 having concave interior chamber 3 and a lower semi-spherical member 4 having a concave interior chamber 5. Said upper member has a circular access port 7 having sides slanted in an outwardly direction which may be pressure sealed by a stopper 8 which is held in position by a hand-operated set screw 9 comprising a frame 10 with a plurality of arms 11, each arm terminating with a hook 12 disposed in a downwardly direction, said hooks 12 being adapted for receiving a plurality of rods 13 fixedly attached to the outer edges of said port 7. Hence when paint and the like is introduced into said container 1 through the port 7, said stopper 8 may be inserted into said port 7 and secured in position by said set screw 9 and frame 10 by engaging said hooks 12 with said rods 13 and tightening down said screw. Said upper member also having a first valve 14, for allowing the contents of said container to be removed and a second valve 15 for allowing water to enter said upper chamber through a circular ring 16 about the upper member 2 of said container 1 spaced apart from said access port 7 and the lower edge of said upper member 2. Said ring 16 having a series of holes about the inner edge thereof directing a water spray throughout the inner chamber 3 of said upper member 2. Said upper and lower members are joined together by a series of thumb screws 17 which are screwed into a first circular flange 18 fixedly attached about the peripheral upper edge of said lower member 4 and which screws pass through a plurality of matching holes in a second flange 19 located about the lower peripheral edge of said upper member 2. A flexible diaphram is held between the upper and lower members by compression between said members. SAid flexible diaphram is in the shape of a derby hat comprising a flat circular ring 21 having a flexible semi-spherical center portion 22 forming a concave chamber. When paint and the like is inserted into said upper chamber 2 the weight of said paint will cause the center portion of said flexible diaphram to extend downward into said lower interior chamber 5.

Said lower member 4 has an intake pipe 23 at the bottom thereof for allowing water to enter the lower chamber 5. A second pipe 24 connects said lower chamber 5 to said second valve 15.

Accordingly, when said port 7 is sealed a hose may be connected to said intake pipe 23 and the water pressure controlled by the water valve at the opposite end of said hose. When pressure is applied by the water to said lower chamber 5, said center portion of said diaphram will extend upwards into said upper chamber 3 and force the contents of said upper chamber 3 through said first valve 14.

When said diaphram is fully extended into said upper chamber 3 said diaphram retains the water between said diaphram and said lower chamber 5 and prevents further flow of paint and the like through said first valve 14. The radius of the spherical portion 22 of said diaphram is slightly shorter than the radius of said upper chamber 3 thereby allowing a small space between said diaphram and said upper chamber 3 still containing paint and the like.

Said second valve 15 may now be opened and water from said lower chamber 5 enters said upper chamber 3 and rinses the contents of said chamber 3 and carries said contents out of the container through said first valve 14.

In operation, said first valve 14 is connected to a flexible hose which in turn is connected to a paint application device such as a roller or the like said roller having an inner chamber for distributing paint along the longitudinal axis of said roller and thence through the body of said roller through the surface due to the pressure applied through the diaphram. Thus, a continuous supply of paint may be applied through said roller until said diaphram is fully extended in an upward direction. Since water is displacing the paint in the volume of the container 1, said container remains stable and is less likely to tip over as the paint is removed from said container. Further, when said second valve 15 is opened, said container 1, hose and paint application apparatus will have a constant flow of water passing through the devices thereby flushing the entire system until clean. When the hose is disconnected the water in said container 1 will exit through said pipe 23 and any remaining water in upper chamber 3 may be dumped out of the first valve 14 without the necessity of opening the access port.

For stability said container is in a circular frame 25 having a hole in the center with a radius less than the circular flange 18 of said lower chamber. Said frame 25 is mounted on at least three legs 26 which hold the bottom of said container a distance sufficient above the floor to allow clearance of pipe 23.

What is claimed by the applicant to be his invention is:

1. A paint container for dispensing paint through a hose to an application device comprising:

a. An upper chamber having at least one valve;
b. A lower chamber attached to said upper chamber;
c. A flexible diaphram attached between said upper and lower chamber;
d. Means for introducing water into said lower chamber, and
e. means for introducing water from said lower chamber about the upper surface of said chamber.

2. a paint container as described in claim 1 wherein said flexible diaphram further comprises:

a. A hollow concave center portion;
b. A circular rim attached about the perimeter of the edge of said center portion.

3. A paint container as described in claim 1 wherein said means for introducing water into said lower chamber further comprises:

a. An intake pipe to which any water source is connected through a hose.

4. A paint container as described in claim 1 further comprising:

a. An access port into said upper chamber, further comprising:
   1. a circular hole, and
   2. an annular ridge about the perimeter of said hole having outwardly slanted sides and a plurality of rods spaced about the outside of said ridge
b. Sealing means for sealing said upper chamber, further comprising:
   1. a circular plug received by said port,
   2. a frame having a plurality of arms,
   3. a plurality of hooks at the end of said arms for engaging said rods, and
   4. a hand operated set screw central of said frame for contact against said plug, whereby said set screw may be screwed down with said hooks engaging said rods thereby applying sealing pressure against said plug.

5. A paint container as described in claim 4 wherein said means for introducing water into said upper chamber further comprises:

a. A pipe connecting said lower chamber and said upper chamber;
b. At least one valve between said upper and lower member controlling the flow of water through said pipe.

6. A paint container as described in claim 5 wherein said means for introducing water into said upper chamber further comprises:

a. a hollow circular ring about the inner surface of said upper chamber having a plurality of holes for distributing water about the inner surface of said chamber and the surface of said diaphram,
b. means for introducing water from said pipe into said ring, whereby a rinsing action is created by various water streams from said holes.

7. A paint container as described in claim 6 wherein said holes direct said water upwardly, downwardly and horizontally.

* * * * *